US008517436B2

(12) United States Patent
Senn

(10) Patent No.: US 8,517,436 B2
(45) Date of Patent: Aug. 27, 2013

(54) CONTAINER DOOR LOCKING ASSEMBLY

(75) Inventor: Brian A. Senn, South Milwaukee, WI (US)

(73) Assignee: Powerbrace Corporation, Kenosha, WI (US)

( * ) Notice: Subject to any disclaimer, the term of this patent is extended or adjusted under 35 U.S.C. 154(b) by 890 days.

(21) Appl. No.: 12/287,788

(22) Filed: Oct. 14, 2008

(65) Prior Publication Data

US 2010/0089107 A1 Apr. 15, 2010

(51) Int. Cl.
*E05C 3/16* (2006.01)
*E05C 3/02* (2006.01)

(52) U.S. Cl.
USPC .... 292/218; 292/240; 292/241; 292/DIG. 32; 292/DIG. 51

(58) Field of Classification Search
USPC ..... 292/218, 240, 241, DIG. 32, DIG. 51
See application file for complete search history.

(56) References Cited

U.S. PATENT DOCUMENTS

| | | | | | |
|---|---|---|---|---|---|
| 1,692,295 | A | | 11/1928 | Gerard | |
| 1,919,328 | A | | 7/1933 | Hansen | |
| 2,298,259 | A | | 10/1942 | Dunham | |
| 2,529,606 | A | * | 11/1950 | Haseltine | 292/192 |
| 2,944,303 | A | * | 7/1960 | Uphues | 292/218 |
| 3,099,473 | A | | 7/1963 | Pastva, Jr. | |
| 3,281,177 | A | | 10/1966 | Tenenbaum | |
| 3,329,456 | A | * | 7/1967 | Olander | 292/218 |
| 3,434,751 | A | | 3/1969 | Tantlinger et al. | |
| 3,451,705 | A | * | 6/1969 | Turpen | 292/218 |
| 3,695,661 | A | | 10/1972 | Pastva | |
| 3,740,978 | A | | 6/1973 | Smith et al. | |
| 3,756,671 | A | | 9/1973 | White | |
| 3,801,146 | A | | 4/1974 | Donath et al. | |
| 3,893,722 | A | | 7/1975 | Galbreath et al. | |
| 3,912,312 | A | * | 10/1975 | Cerutti | 292/218 |
| 4,014,138 | A | * | 3/1977 | White | 49/367 |
| 4,068,409 | A | | 1/1978 | White | |
| 4,768,816 | A | * | 9/1988 | Bakula | 292/218 |
| 4,843,857 | A | * | 7/1989 | Krieps | 72/58 |
| 4,869,023 | A | | 9/1989 | Bakula et al. | |
| 5,046,770 | A | | 9/1991 | Hansen | |
| 5,165,740 | A | | 11/1992 | Curnes et al. | |

(Continued)

OTHER PUBLICATIONS

International Searching Authority; PCT International Search Report regarding International PCT patent application No. PCT/US2009/05496; Dec. 2, 2009; 2 Sheets; USA.

(Continued)

*Primary Examiner* — Carlos Lugo
*Assistant Examiner* — Alyson M Merlino
(74) *Attorney, Agent, or Firm* — Law Office of John W. Harbst

(57) ABSTRACT

A locking assembly for a swinging door of a container. The locking assembly includes an axially elongated lock rod having cam structure at opposed ends thereof. The lock rod is provided, toward each end thereof, with axially spaced radial projections which are axially fixed relative to the lock rod and define a channel therebetween. The locking assembly further includes a pair of guide plates; with each guide plate rotatably accommodating a lengthwise portion of the lock rod between the plate and the door. Each guide plate further includes structure for allowing each plate to be fastened to the door. After each guide plate is fastened to the door, a portion of each plate is entrapped between the axially spaced radial projections on the lock rod whereby inhibiting axial shifting movements of the lock rod.

33 Claims, 9 Drawing Sheets

(56) References Cited

U.S. PATENT DOCUMENTS

| | | | | |
|---|---|---|---|---|
| 5,718,466 | A * | 2/1998 | Weinerman et al. | 292/218 |
| 5,718,467 | A | 2/1998 | Weinerman et al. | |
| 6,779,818 | B2 | 8/2004 | Senn | |
| 6,854,775 | B2 | 2/2005 | Senn | |
| 6,860,530 | B2 | 3/2005 | Senn | |
| 6,886,870 | B2 * | 5/2005 | Ehrlich | 292/240 |
| 7,234,755 | B1 | 6/2007 | Senn | |
| 7,306,267 | B2 | 12/2007 | Senn | |
| 2009/0236864 | A1 * | 9/2009 | Ehrlich et al. | 292/217 |

OTHER PUBLICATIONS

International Searching Authority; PCT Written Opinion regarding International PCT patent application No. PCT/US2009/05496; Dec. 2, 2009; 10 sheets ; USA.

* cited by examiner

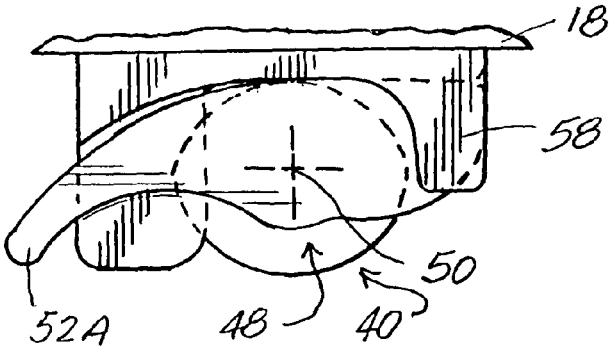
FIG. 4
FIG. 3
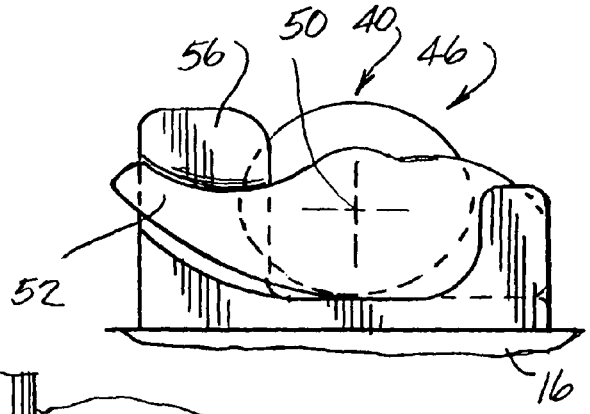
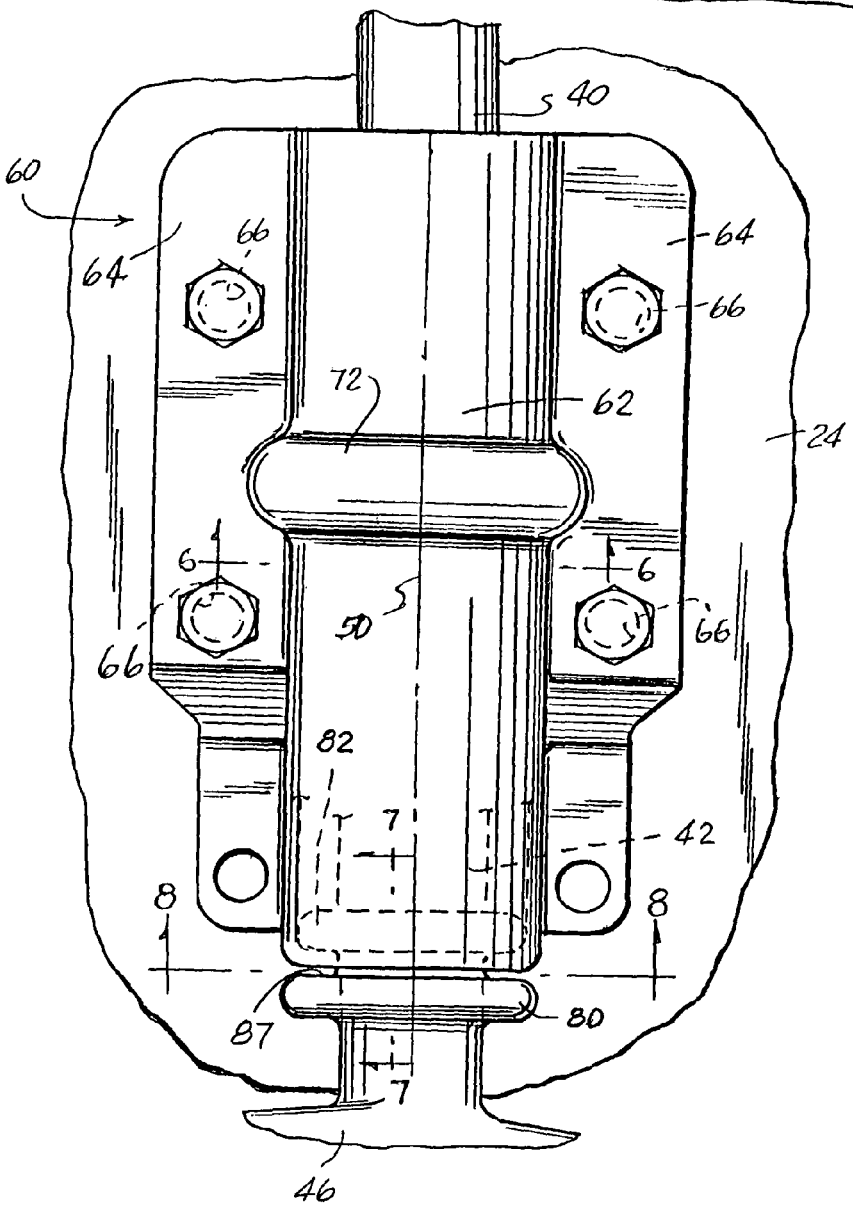
FIG. 5

CONTAINER DOOR LOCKING ASSEMBLY

FIELD OF THE INVENTION DISCLOSURE

The present invention disclosure generally relates to containers having one or more access doors and, more specifically, to a locking assembly for releasably maintaining the one or more doors on the container in a closed position.

BACKGROUND OF THE INVENTION DISCLOSURE

Van type trucks, semi-trailers and other cargo containers, hereinafter generally referred to as a "container" and/or "cargo container" have enclosed bodies with a generally rectangular door frame typically at one end of the container. One or more doors on the container are hingedly connected along one side to the door frame whereby permitting the doors to swing within the plane of the door frame and are used to releasably close the open end of the container. Typically, a generally vertically disposed locking assembly selectively retains the doors in the door frame. In most instances, the doors on the container are made as large as possible to facilitate loading and unloading of the container.

The door frame on a typical container includes a top member and a bottom member rigidly interconnected by spaced side members. To promote loading and unloading of the container and to maximize interior cargo space, the door frame is usually fabricated of structural members having the least strength practical. To further facilitate loading and unloading of the container, the top frame member or header is fabricated as narrow as possible as to not hinder loading and unloading of the container.

The forces to which the doors and door frames of such containers have been subjected as the container travels between locations are commonly referred to as "racking" forces. These forces tend to move the doors vertically relative to one another and to the door frame. Because the doors and the door frame of such containers are generally utilized to insure the structural integrity of the container, the locking assembly associated with each door of the container must be able to withstand the racking forces and positively retain the doors properly closed within and relative to the door frame.

A conventional locking assembly typically includes an axially elongated lock rod rotatably attached to an exterior side of the door and extends generally parallel to a pivot axis for the door or adjacent to the door's free end. A handle is usually attached to and extends radially from the lock rod to facilitate selective rotation thereof. Cam structure is provided toward opposed ends of the lock rod. Such cam structure typically includes a locking tongue or finger which radially extends from the axis of rotation of the lock rod. As known, and upon suitable rotation of the locking rod, the locking tongue on each cam structure coacts with a keeper secured to the respective top and bottom members of the door frame so as to provide a useful mechanical advantage to close the door even though the door frame may be twisted or canted.

There is a need and continuing desire for a locking assembly for a container which has improved structure and operation.

SUMMARY OF THE INVENTION DISCLOSURE

In view of the above, and in accordance with one aspect, there is provided a locking assembly for a swinging door of a container. The locking assembly includes an axially elongated lock rod having cam structure at opposed ends thereof.

The lock rod is provided, toward a first end thereof, with axially spaced radial projections which are axially fixed relative to the lock rod and define a channel therebetween. The locking assembly further includes first and second guide plates. Each guide plate rotatably accommodates a lengthwise portion of the lock rod between the plate and the door. Each guide plate further includes structure for allowing each plate to be fastened to the door. The first guide plate defines a first plate portion which extends into the channel between said first and second axially spaced radial projections on the lock rod when said first guide plate is fastened to the door with the lock rod trapped between said first guide plate and said door. With the guide plate fastened to the door, the first plate portion on the guide plate and the first and second axially spaced radial projections on the lock rod combining to inhibit axial shifting movements of the lock rod.

Preferably, the first plate portion on the first guide plate comprises a generally U-shaped rolled nose portion formed integral with and toward one end of the first guide plate. Moreover, each guide plate is preferably formed from metal and has a predetermined cross-sectional thickness. In one form, the axial spacing between opposed surfaces on the first and second radial projections on the lock rod is generally equal to or slightly greater than the predetermined cross-sectional thickness of the guide plate.

In one form, at least one of the first and second radial projections on the lock rod is formed integral with the lock rod. Preferably, both the first and second radial projections on the lock rod are formed integral with the lock rod.

In one embodiment, the lock rod is provided toward a second end thereof with third and fourth axially spaced radial projections defining a second channel therebetween. The third and fourth axially spaced projections are axially fixed relative to the lock rod. In this embodiment, the second guide plate defines a second plate portion which extends into the second channel between the third and fourth axially spaced radial projections on the lock rod when the second guide plate is fastened to the door with the lock rod trapped between the second guide plate and the door. With the second guide plate fastened to the door, the second plate portion on the second guide plate combines with the third and fourth radial projections on the lock rod to inhibit axial shifting movements of the lock rod.

Preferably, the second plate portion on the second guide plate comprises a generally U-shaped rolled nose portion formed integral with and toward one end of the second guide plate. Additionally, and in a preferred embodiment, the axial spacing between opposed surfaces on the third and fourth radial projections on the lock rod is generally equal to or slightly greater than the predetermined cross-sectional thickness of the guide plate.

In one form, at least one of the third and fourth radial projections on the lock rod is formed integral with the lock rod. In another form, both the third and fourth radial projections on the lock rod are formed integral with the lock rod. Preferably, a handle is connected to and extends radially outward from the lock rod for facilitating rotation of the lock rod.

According to another aspect, there is provided a locking assembly for a container having a door pivotally supported for swinging movements within a complimentary door frame on the container. As is conventional, the container door frame has a top member and a bottom member rigidly joined to each other by generally parallel side members. The locking assembly includes a lock rod having first and second ends. Cam structure is provided toward each end of the lock rod. The cam structure at one end of the lock rod movably engages and cooperates with a first keeper secured to the bottom frame member. The cam structure at the opposite end of the lock rod movably engages and cooperates with a second keeper secured to the top frame member whereby either releasably and selectively holding said door in a closed position or for allowing said cam structure to release and separate from the keepers so as to allow the door to be swung to an open position. First and second guide plates are adapted to be secured to the door on the container. A midportion of each guide plate is configured to movably engage and entrap a lengthwise portion of the lock rod between the midportion of each guide plate and the door in a manner permitting the lock rod to rotate about a fixed axis. The first guide plate defines a first plate portion extending into a channel defined between first and second axially spaced radial projections on the lock rod when the first guide plate is fastened to the door. With the first guide plate fastened to the door, the first plate portion on the first guide plate and the axially spaced radial projections on the lock rod combine to inhibit axial shifting movements of the lock rod.

Preferably, the first plate portion on the first guide plate comprises a generally U-shaped rolled nose portion formed integral with and toward one end of the first guide plate. In one form, each guide plate is formed from metal and has a predetermined cross-sectional thickness. In one form, the axial spacing between opposed surfaces on the first and second radial projections on the lock rod is generally equal to or slightly greater than the predetermined cross-sectional thickness of the guide plate.

In one form, at least one of the first and second radial projections on the lock rod is formed integral with the lock rod. In a preferred embodiment, both the first and second radial projections on the lock rod are formed integral with the lock rod.

According to a preferred form, the lock rod is provided toward the second end thereof with third and fourth axially spaced radial projections arranged for rotation with the lock rod and defining a second channel therebetween. In this form, the second guide plate defines a second plate portion which extends into the second channel between the third and fourth axially spaced radial projections on said lock rod when the second guide plate is fastened to the door. With the second guide plate fastened to the door, the second plate portion on the second guide plate and the third and fourth radial projections on the lock rod combine to inhibit axial shifting movements of the lock rod.

Preferably, the second plate portion on the second guide plate comprises a generally U-shaped rolled nose portion formed integrally with and toward one end of the second guide plate. In one form, the axial spacing between opposed surfaces on the third and fourth radial projections on the lock rod is generally equal to or slightly greater than the predetermined cross-sectional thickness of the guide plate.

In one form, at least one of the third and fourth radial projections on the lock rod is formed integral with the lock rod. Alternatively, both the third and fourth radial projections on the lock rod are formed integral with the lock rod. Moreover, a handle is preferably connected to and extends radially outward from the lock rod for facilitating rotation of the lock rod.

According to another aspect, there is provided a locking assembly for a vehicle trailer having an open end, with two doors pivotally supported for swinging movements within a complimentary door frame on the trailer. The door frame has a top member and a bottom member rigidly joined to each other by generally parallel side members. The locking assembly includes a lock rod having first and second ends. The lock rod is rotatably mounted in an upright position adjacent to a side of one of the doors, which door side is adjacent a complimentary side of the other door when both doors are in a position to close the open end of the vehicle trailer. Cam structure is provided toward each end of the lock rod. Each cam structure provided toward an end of the lock rod includes a locking tongue for movably engaging and cooperating with a respective keeper secured to the adjacent frame member. Suffice it to say, the cam structures on the locking rod either releasably and selectively hold the door in a closed position or allow the locking tongues to be released and separate from the keepers so as to allow the door to be swung to an open position. The locking assembly furthermore includes first and second guide plates for mounting the lock rod to the door. Each guide plate is configured to movably engage and entrap a lengthwise portion of the lock rod between each guide plate and the door in a manner permitting the lock rod to rotate about a fixed axis. The first guide plate defines a portion extending between and operably engages with the first and second radial projections on the lock rod when the first guide plate is fastened to the door. After the first guide plate is fastened to the door, the portion on the first guide plate combines with the first and second radial projections on the lock rod to inhibit racking movements of the doors as the vehicle moves between locations.

In one form, each guide plate is formed from metal and has a predetermined cross-sectional thickness. In this embodiment, the axial spacing between opposed surfaces on the first and second radial projections on the lock rod is generally equal to or slightly greater than the predetermined cross-sectional thickness of the guide plate.

In one form, at least one of the first and second radial projections on the lock rod is formed integral with the lock rod. Alternatively, both the first and second radial projections on the lock rod are formed integral with the lock rod.

In another form, the lock rod is provided toward the second end thereof with third and fourth axially spaced radial projections arranged for rotation with the lock rod and defining a second channel therebetween. In this form, the second guide plate defines a portion which extends between and into operable engagement with the third and fourth radial projections on the lock rod when the second guide plate is fastened to the door. After the second guide plate is fastened to the door, the second portion on the second guide plate combines with the third and fourth radial projections on the lock rod to inhibit axial shifting movements of the lock rod. Preferably, a handle is connected to and extends radially outward from the lock rod for facilitating manual rotation of the lock rod.

DESCRIPTION OF THE DRAWINGS

FIG. 3 is a bottom plan view of one form of camming structure associated with another end of the locking assembly illustrated in FIG. 1;

FIG. 4 is a top plan view of another form of camming structure associated with one end of the locking assembly illustrated in FIG. 1;

FIG. 5 is a fragmentary enlarged plan view of one end of an illustrative embodiment of a locking assembly secured to a door of the container;

DETAILED DESCRIPTION OF THE INVENTION DISCLOSURE

Figure 2:
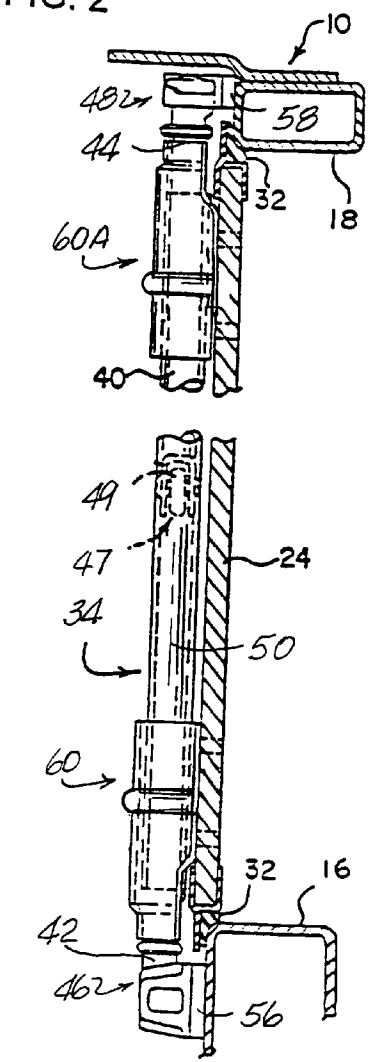
FIG. 2 is a partial sectional view taken along line 2-2 of FIG. 1.

While the present invention disclosure is susceptible of embodiment in multiple forms, there is shown in the drawings and will hereinafter be described preferred embodiments of the invention disclosure, with the understanding the present disclosure is to be considered as setting forth exemplifications which are not intended to limit the invention disclosure to the specific embodiments illustrated and described.

Figure 1:
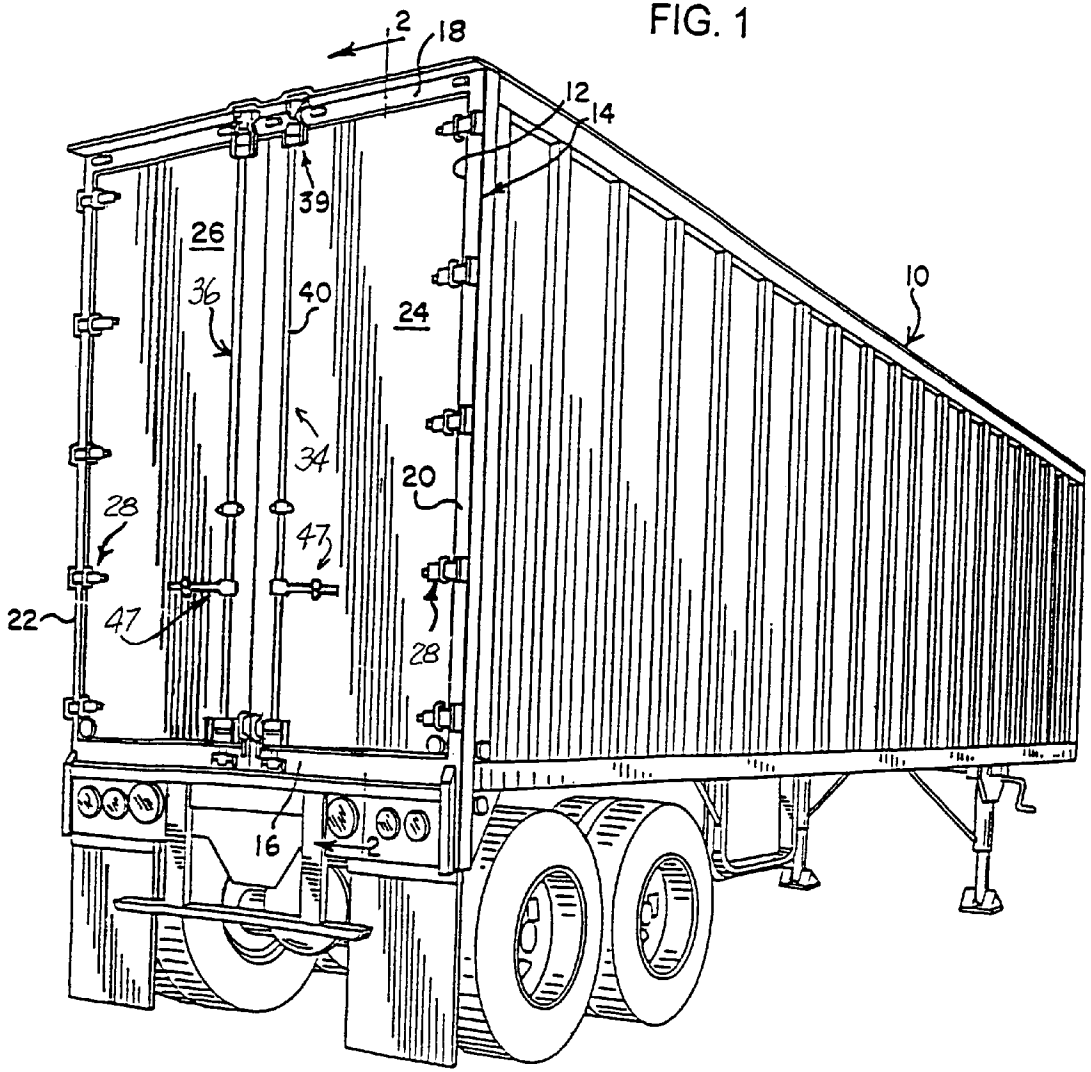
FIG. 1 is a perspective view of one illustrative embodiment of a locking assembly for a door of a container and, more particularly, for a mobile storage container or truck trailer.

Referring now to the drawings, wherein like reference numerals indicate like parts throughout the several views, FIG. 1 illustrates a conventional trailer truck body 10. While the principals and concepts of this disclosure are described in relation to a trailer truck body, it will be understood they are equally applicable to containers generally and, more specifically, to containers for transporting one or more objects, examples of which include, but are not limited to straight truck bodies, small personal and/or commercial trailers and the like.

In the illustrated example, container 10 has, at its rear end, a doorway opening 12. Opening 12 is defined by a frame 14 including a bottom frame member or sill 16 transversely extending across a lower edge of the frame 14 and a top frame member or header 18 transversely extending across an upper edge of the frame 14. Upright side frame members 20 and 22 rigidly join the header and sill. Disposed within the frame 14 for closing the opening 12 are a pair of doors 24 and 26 which are connected along one side edge to the frame members 20 and 22 by means of hinges 28 which allow each door to be swung within a plane defined by the frame 14.

Turning to FIG. 2, to provide a suitable seal closure between a door and the trailer, resilient strip material 32 having a suitable cross-sectional configuration may be secured about the edges of the doors. The strip material 32 extending along one vertical side edge of a door may be arranged to overlap the vertical edge of the other door.

In the illustrated embodiment, the doors 24 and 26 are adapted to be maintained in a closed position relative to the opening 12 by locking assemblies 34 and 36, respectively. That is, each locking assembly 34, 36 engages a different one of and maintains a respective one of the doors 24, 26 in a closed position as will be more fully described below. It should be appreciated, however, in some instances more than one locking assembly can be used in combination with either or both doors without detracting or departing from the spirit and scope of the present disclosure. Since the locking assemblies 34 and 36 are mirror images of each other, only locking mechanism 34, and the components associated therewith, will be discussed in detail.

As shown in FIG. 2, each locking assembly includes an axially elongated lock rod 40 having a predetermined diameter along with first and second ends 42 and 44, respectively. Lock rod 40 has camming structure 46 and 48 arranged at the ends 42 and 44, respectively, thereof. As will be understood, the camming structure 46, 48 rotates with the lock rod 40. Intermediate opposed ends thereof, each locking assembly 40 furthermore preferably includes handle structure 47 including a pivoting handle 49 extending radially outward from the lock rod 40 for facilitating manual rotation of the lock rod 40. As is known, the handle structure 47 can be suitably secured to the door when not is use.

The lock rod 40 is rotatably arranged generally upright and extends generally parallel to an exterior face of the door to which it is secured for rotation about a generally vertical axis 50 (FIG. 2). In the illustrated embodiment, the lock rod 40 is laterally spaced from the hinged edge of the door and is preferably arranged proximate to the opposite side edge of door adjacent a complimentary side edge of the other door when both doors 24, 26 are in a position to close the open end 12 of the container 10.

As is conventional, the camming structure 46 and 48 at the ends of the locking rod 40 is adapted to cooperate with keepers 56 and 58 secured to the sill and header 16 and 18, respectively, on frame 14. That is, the camming structure 46 toward the end of lock rod 40 cooperates in an interengaging relationship with keeper 56 on the sill 16 to maintain the respective door in the closed position. Camming structure 48, arranged toward the other end of the lock rod 40, cooperates in an interengaging relationship with keeper 58 on header 18 and cooperates with structure 46 and keeper 56 to hold the respective door in the closed position.

In the embodiment illustrated in FIG. 3, the camming structure 46 toward the one end of lock rod 40 includes a locking tongue 52 extending radially and away from the axis 50 of the locking rod 40. The locking tongue 52 on camming structure 46 movably engages and cooperates with the keeper 56 on the frame sill 16 so as to either releasably and selectively hold the door in a closed position or, after the locking tongue 52 releases and separates from the keeper 56, allows the door to be swung to an open position thereby providing access to an interior of the container 10 through opening 12 (FIG. 1).

In the embodiment illustrated in FIG. 4, camming structure 48 preferably includes a locking tongue 52A extending radially and away from the axis 50 of the locking rod 40. The locking tongue 52A on camming structure 48 movably engages and cooperates with the keeper 58 on the frame header 18 so as to either releasably and selectively hold the door in a closed position or, after the locking tongue 52A releases and separates from the keeper 58, allows the door to be swung to an open position thereby providing access to an interior of the container 10 through opening 12 (FIG. 1).

As illustrated in FIG. 2, the lock rod 40 of each locking assembly is attached to the respective door by means of a first or lower guide plate 60 and a second or upper guide plate 60A. The guide plates 60 and 60A serve to secure the lock rod 40 to the respective door for rotation about the fixed axis 50. As shown in FIGS. 2 and 5, guide plate 60 surrounds and entraps a lengthwise portion of the elongated lock rod 40 between the plate 60 and an exterior surface of the respective door to which guide plate is secured. In the embodiment shown in FIG. 5, guide plate 60 has a generally semi-cylindrical or U-shaped central portion 62 and a pair of side flanges 64 extending outwardly from the central portion 62 and adapted to be seated flush against the exterior surface of the door to which the guide plate 60 is secured preferably adjacent to the side edge of the door opposite from the edge hingedly secured to the frame 14 (FIG. 1). The central portion 62 of guide plate 60 has a diameter larger than that portion of the lock rod 40 endwise passing therethrough. In the illustrated embodiment, the side flanges 64 of guide plate 60 are provided with a series of bores or openings 66 so as to allow a series of fasteners, i.e. bolts, to extend therethrough whereby securing the guide plate 60 to the door. In one form, guide plate 60 has a predetermined thickness and is preferably formed from a 10 gauge metal or steel stamping.

Figure 6:
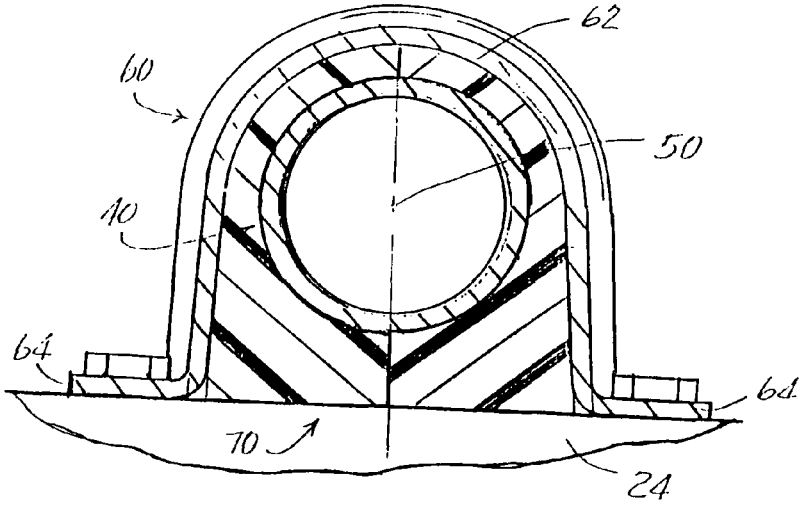
FIG. 6 is a sectional view taken along line 6-6 of FIG. 5.

In the example illustrated in FIG. 6, the guide plate 60 furthermore preferably includes a plastic bushing 70 for journaling a lengthwise portion of the lock rod 40 passing therethrough. In the illustrated embodiment, bushing 70 is maintained in nonrotatable relation relative to the lock rod 40. The plastic bushing is preferably of the type disclosed in U.S. Pat. No. 7,306,267 to B. A. Senn; the applicable portions of which are incorporated herein by reference. Suffice it to say, and to facilitate assembly, bushing 70 is preferably configured with a split design and is disposed between a lengthwise section of the central portion 62 of guide plate 60 and the exterior of the respective door to which guide plate 60 is secured. As shown in FIG. 5, interposed between its axial ends, guide plate 60 is preferably provided with a detent or radial projection 72 which accommodates a portion of the bushing 70 (FIG. 5) therewithin so as to limit axial displacement of the bushing 70 relative to the guide plate 60.

Returning to that embodiment illustrated in FIG. 5, the locking rod 40 further includes first and second radial projections 80 and 82 axially spaced inwardly from and preferably proximate to the camming structure 46 on lock rod 40. Preferably, projection 80 extends away from the axis 50 of the lock rod 40 a radial distance equal to or slightly greater than the radial distance an outer surface of the generally U-shaped central portion 62 of plate 60 is spaced from the axis 50 of the lock rod 40. Moreover, projection 82 preferably extends away from the axis 50 of the lock rod 40 a radial distance slightly less than the radial distance an inner surface of the generally U-shaped central portion 62 is spaced from the axis 50 of the lock rod 40.

Figure 7:
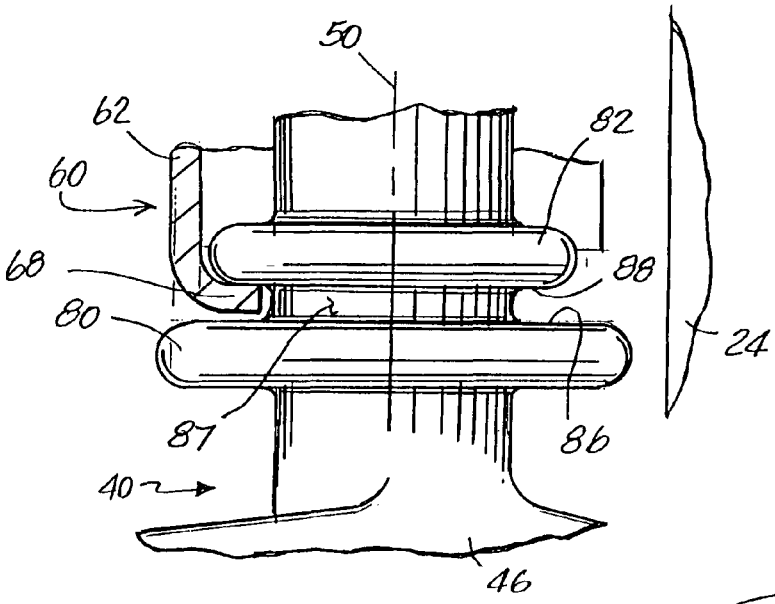
FIG. 7 is a sectional view taken along line 7-7 of FIG. 5.

As shown in FIG. 7, the radial projections 80 and 82 define an open-sided channel 87 therebetween. Preferably, radial projections 80 and 82 define confronting surface 86 and 88, respectively, defining the width of the channel 87 therebetween. In a most preferred form, the axial distance between the surfaces 86 and 88 of projections 80 and 82, respectively, i.e., the axial width of channel 87, is about equal to or slightly greater than the predetermined thickness of guide plate 60.

In one form, the projections 80 and 82 on lock rod 40 are designed as annular rings which annularly extend about the lock rod 40. Preferably, at least one of the radial projections 80 and 82 is formed integral with the lock rod 40. In a most preferred embodiment, both radial projections 80 and 82 are formed integral with the lock rod 40. It will be appreciated, however, radial projections having design configurations other than that described above can be used without detracting or departing from the spirit and scope of the subject disclosure.

As shown in FIG. 7, when the guide plate 60 is secured to the respective door, a first portion 68 of the guide plate 60 extends into and is received within the channel 87 defined between the first and second radial projections 80 and 82, respectively, on lock rod 40. As will be appreciated, and after the guide plate 60 is secured to the respective door, with portion 68 of the guide plate 60 accommodated within the channel 87 and axially entrapped between the first and second projections 80 and 82 defined by the lock rod 40, the lock rod 40 is inhibited against axial movements while simultaneously allowing for rotation of the lock rod 40 about axis 50 to affect opening and closing of the respective door, as required. Moreover, with portion 68 of guide plate 60 entrapped and held between the first and second radial projections 80, 82 on the lock rod 40, the so called "racking" of the doors 24, 26 relative to the door frame 14 (FIG. 1) is inhibited.

Figure 8:
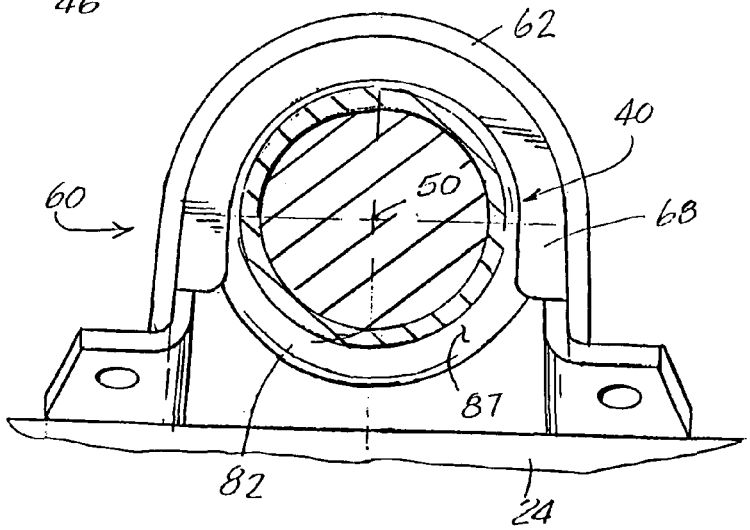
FIG. 8 is a partial sectional view taken along line 8-8 of FIG. 5.

In the embodiment illustrated in FIG. 7, an end portion of the central portion 62 of guide plate 60 disposed closest to the camming structure 46 is preferably rolled to provide a generally U-shaped nose portion 68 on the guide plate 60. Since the rolled nose end portion 68 is formed as part of guide plate 60, the rolled nose end portion 68 has a predetermined thickness substantially equal to the reminder of the guide plate 60. As shown in FIGS. 7 and 8, the generally U-shaped nose end portion 68 of guide plate 60 extends into and is received within the channel 87 when the guide plate 60 is secured to the door. Preferably, the generally U-shaped nose end portion 68 of plate 60 extends at least partially about each radial projection 82, 84 on the lock rod 40. As shown in FIGS. 7 and 8, the rolled nose end portion 68 preferably extends into the channel 87 between and about a majority of the confronting surfaces 86 and 88 on the radial projections 80 and 82, respectively, whereby inhibiting axial shifting movements of the lock rod 40 relative to the respective door.

Figure 9:
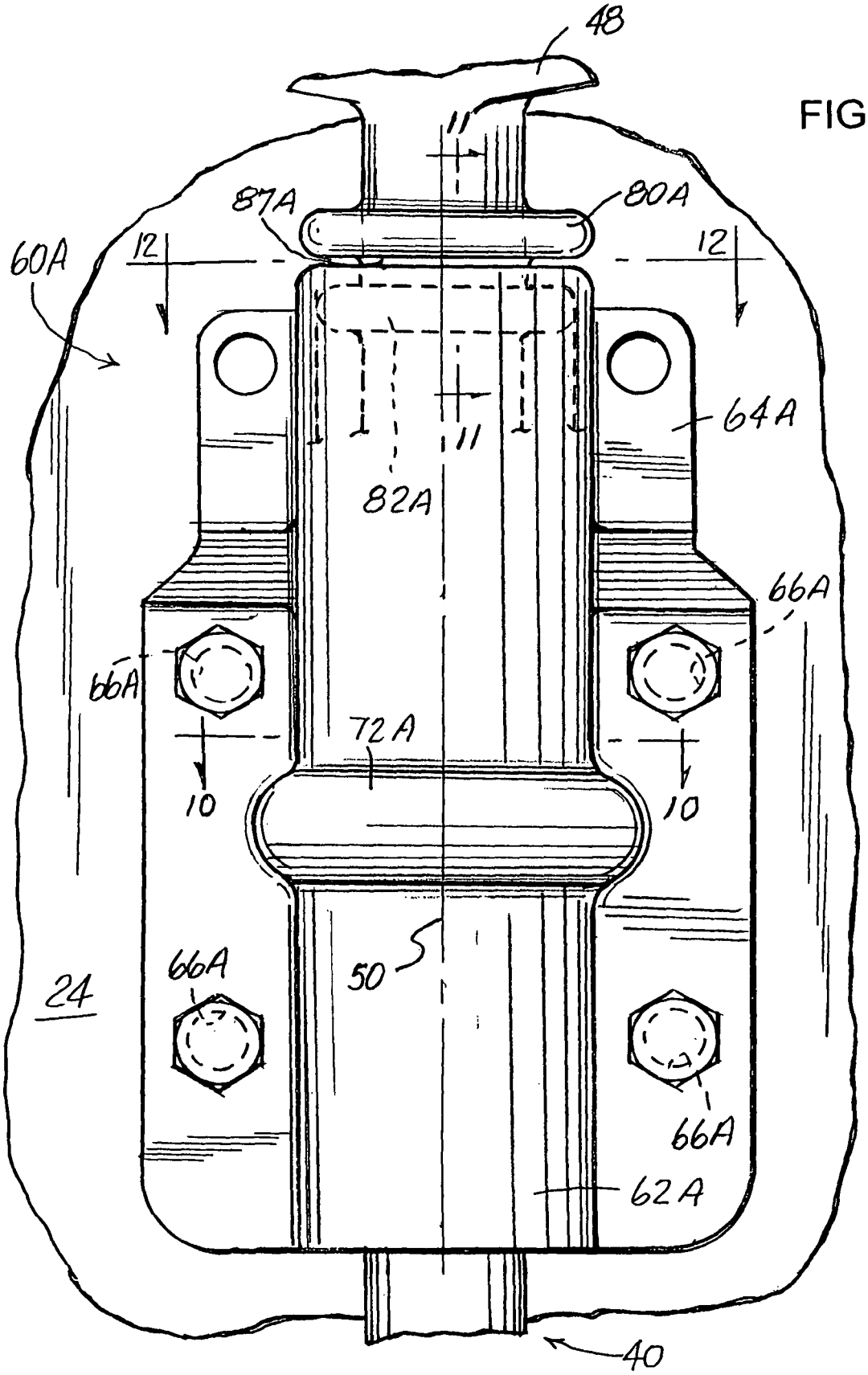
FIG. 9 is an enlarged plan view of another end the locking rod with a locking assembly secured to the door of the container.

As shown in FIG. 9, plate 60A surrounds and entraps another lengthwise portion of the lock rod 40 between the plate 60A and an exterior surface of the respective door to which guide plate is secured. In the embodiment shown in FIG. 9, guide plate 60A has a generally semi-cylindrical or U-shaped central portion 62A and a pair of side flanges 64A extending outwardly from the central portion 62A and adapted to be seated flush against the exterior surface of the door to which the guide plate 60A is secured preferably adjacent to the side edge of the door opposite from the edge hingedly secured to the frame 14 (FIG. 1). In the illustrated embodiment, the side flanges 64A of guide plate 60A are provided with a series of bores or openings 66A so as to allow a series of fasteners, i.e. bolts, to extend therethrough whereby securing the guide plate 60A to the door. The central portion 62A of guide plate 60A has a diameter larger than that portion of the lock rod 40 endwise passing therethrough. In one form, guide plate 60A has a predetermined thickness and is preferably formed from a 10 gauge metal or steel stamping.

Figure 10:
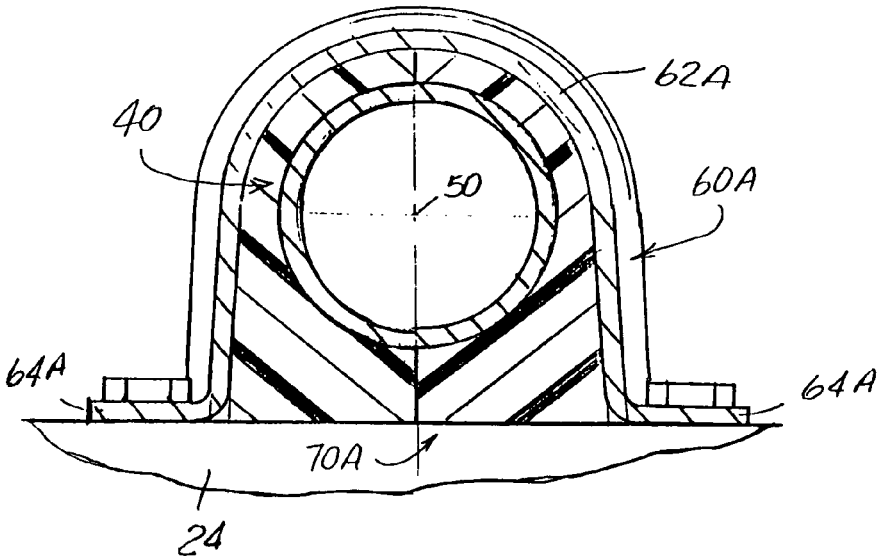
FIG. 10 is a sectional view taken along line 10-10 of FIG. 9.

As shown in FIG. 10, guide plate 60A furthermore preferably includes a plastic bushing 70A for journaling a lengthwise portion of the lock rod 40 passing therethrough. In the illustrated embodiment, bushing 70A is maintained in nonrotatable relation relative to the lock rod 40. As discussed above, the plastic bushing is preferably of the type disclosed in U.S. Pat. No. 7,306,267 to B. A. Senn; the applicable portions of which are incorporated herein by reference. Suffice it to say, and to facilitate assembly, bushing 70A is preferably configured with a split design and is disposed between a lengthwise section of the central portion 62A of guide plate 60A and the exterior of the respective door to which guide plate 60A is secured. As shown in FIG. 9, interposed between its axial ends, guide plate 60A is preferably provided with a detent or radial projection 72A which accommodates a portion of the bushing 70A (FIG. 10) therewithin so as to limit axial displacement of the bushing 70A relative to the guide plate 60A.

In the embodiment shown in FIG. 9, the lock rod 40 further includes third and fourth radial projections 80A and 82A axially spaced inwardly from and preferably proximate to the camming structure 48 on lock rod 40. Preferably, projection 80A extends away from the axis 50 of the lock rod 40 a radial distance equal to or slightly greater than the radial distance an outer surface of the central portion 62A is spaced from the axis 50 of the lock rod 40. Moreover, projection 82A preferably extends away from the axis 50 of the lock rod 40 a radial distance slightly less than the radial distance an inner surface of the central portion 62A is spaced from the axis 50 of the lock rod 40.

Figure 11:
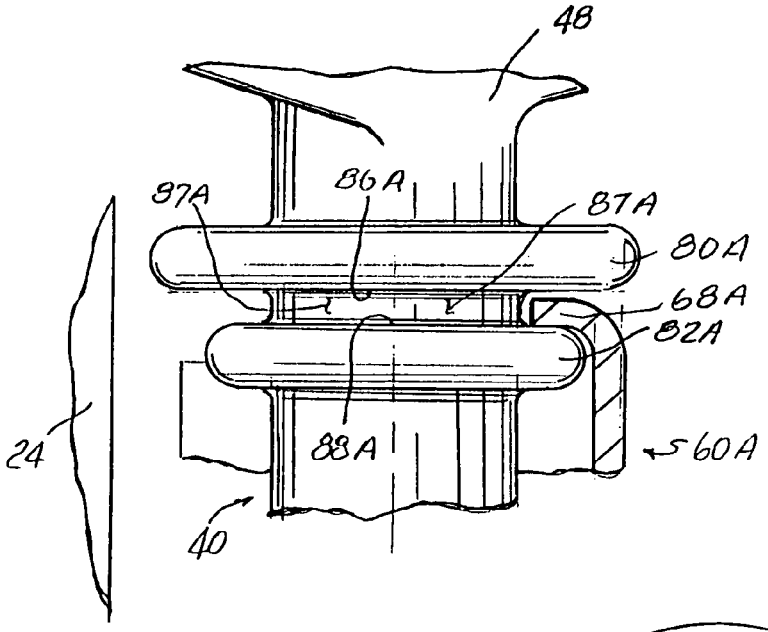
FIG. 11 is a sectional view taken along line 11-11 of FIG. 10.

As shown in FIGS. 9 and 11, the third and fourth radial projections 82A and 84A define a second open-sided channel 87A therebetween. Preferably, the radial projections 82A and 84A define confronting surface 86A and 88A, respectively, defining the width of the channel 87A therebetween. In a most preferred form, the axial distance between the surfaces 86A and 88A of projections 82A and 84A, respectively, i.e., the axial width of channel 87A, is about equal to or slightly greater than the predetermined thickness of the guide plate 60A.

The third and fourth projections 82A and 84A on lock rod 40 are preferably designed as annular rings which extend about the lock rod 40. In one form, at least one of the radial projections 80A and 82A is formed integral with the lock rod 40. In a most preferred embodiment, both radial projections 80A and 82A are formed integral with the lock rod 40. It will be appreciated, however, radial projections having configurations other than described above can be used without detracting or departing from the spirit and scope of the subject disclosure.

As shown in FIG. 11, when the guide plate 60A is secured to the respective door, a portion 68A of guide plate 60A extends into and is received within the channel 87A defined between the third and fourth radial projections 80A and 82A, respectively, on the lock rod 40. As will be appreciated, and after the guide plate 60A is secured to the respective door, with portion 68A of the guide plate 60A accommodated in the channel 87A and axially entrapped between the third and fourth projections 80A and 82A on the lock rod 40, the lock rod 40 is inhibited against axial movements while simultaneously allowing for rotation of the lock rod 40 about axis 50 to affect opening and closing of the respective door, as required. Moreover, with both portions 68 and 68A of the guide plates 60 and 60A entrapped and held between the projections 80, 82 and 80A, 82A on the lock rod 40, the so called "racking" of the doors 24, 26 relative to the door frame 14 (FIG. 1) is significantly inhibited.

Figure 12:
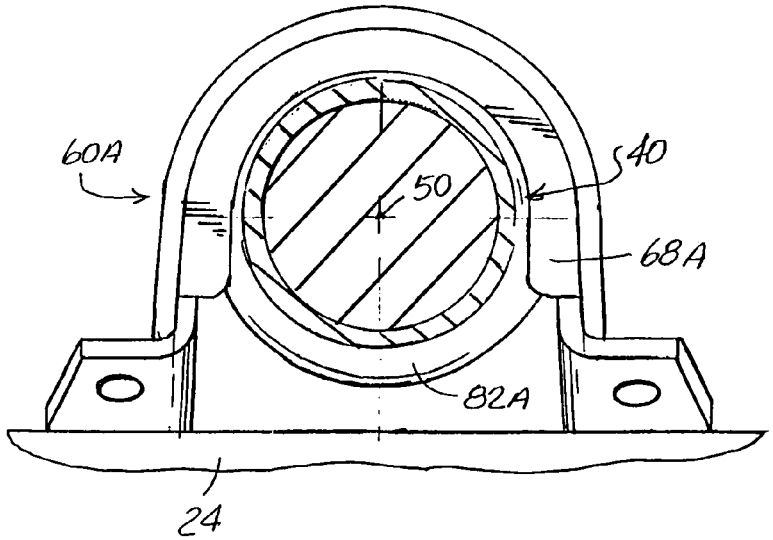
FIG. 12 is a partial sectional view taken along line 12-12 of FIG. 9.

In the embodiment illustrated in FIG. 11, an end portion of the central portion 62A of guide plate 60A disposed closest to the camming structure 48 is preferably rolled to provide a generally U-shaped nose portion 68A on the guide plate 60A. Since the rolled nose end portion 68A is formed as part of guide plate 60A, the rolled nose end portion 68A has a predetermined thickness substantially equal to the reminder of the guide plate 60A. As shown in FIGS. 11 and 12, the generally U-shaped rolled nose end portion 68A of guide plate 60A extends into and is received within the channel 87A when the guide plate 60 is secured to the door. Preferably, the generally U-shaped rolled nose end portion 68A of plate 60A extends at least partially about the third and fourth radial projection 80A, 82A on the lock rod 40. As shown in FIGS. 11 and 12, the rolled nose end portion 68A preferably extends into the channel 87A between and about a majority of the confronting surfaces 86A and 88A on the radial projections 80A and 82A, respectively, whereby inhibiting axial shifting movements of the lock rod 40 relative to the respective door.

Figure 13:
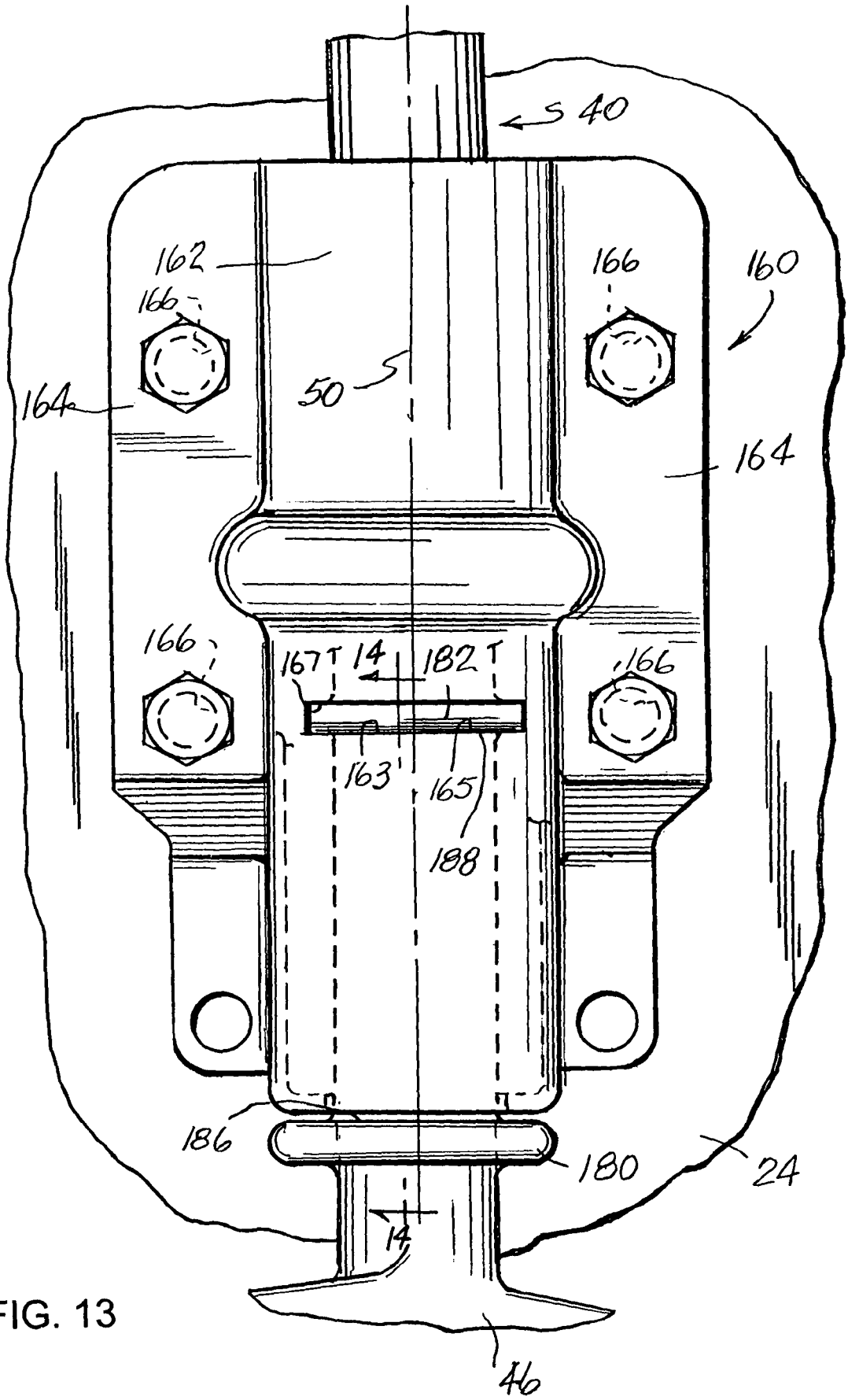
FIG. 13 is an enlarged plan view of one end of another illustrative embodiment of a locking assembly secured to the door of the container.
Figure 14:
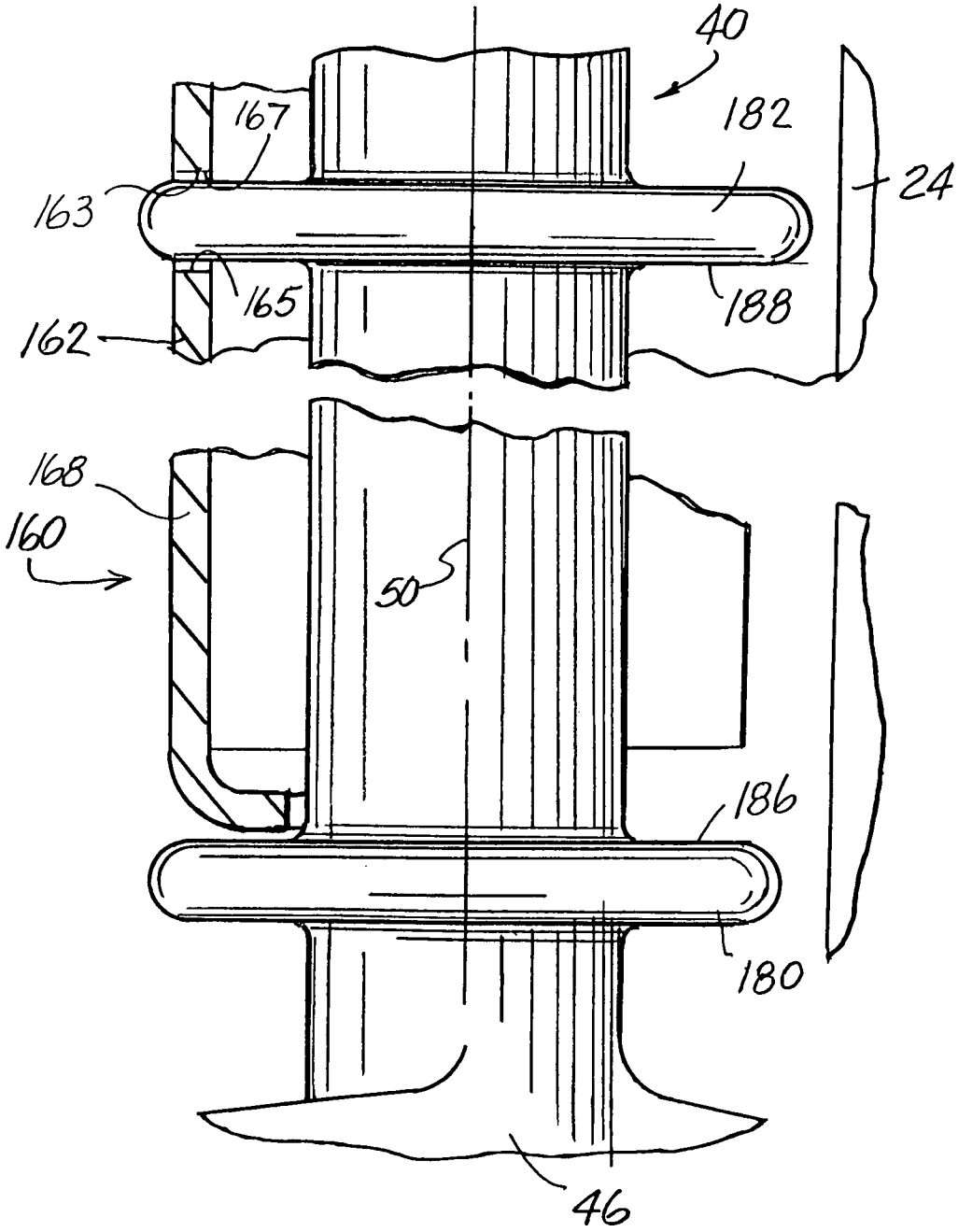
FIG. 14 is a fragmentary sectional view taken along line 14-14 of FIG. 13.

FIGS. 13 and 14 illustrate an alternative construction for inhibiting "racking" of the doors by limiting axial displacement of the lock rod relative to the guide plates. The elements of this alternative arrangement that are functionally analogous to those components discussed above are designated by similar reference numerals to those listed above with the exception this embodiment uses reference numerals in the 100 series.

As shown in FIG. 13, a guide plate 160 surrounds and entraps a lengthwise portion of the elongated lock rod 40 between the plate 160 and an exterior surface of the respective door to which the guide plate is secured. In the embodiment shown in FIG. 13, guide plate 160 has a generally semi-cylindrical or generally U-shaped central portion 162 and a pair of side flanges 164 extending outwardly from the central portion 162 and adapted to be seated flush against the exterior surface of the door to which the guide plate 160 is secured preferably adjacent to the side edge of the door opposite from the edge hingedly secured to the frame 14 (FIG. 1). In the illustrated embodiment, the central portion 162 of guide plate 160 is generally U-shaped section in cross-section and has a diameter larger than the predetermined diameter of that portion of the lock rod 40 endwise passing therethrough. Like plate 60, the side flanges 164 of guide plate 160 are configured with a series of openings 166 for allowing a series of fasteners, i.e. bolts, to extend therethrough whereby securing the guide plate 160 to the door.

In the example illustrated in FIG. 13, guide plate 160 furthermore includes a plastic bushing (not shown) for journaling a lengthwise portion of the lock rod 40 passing therethrough. Bushing 170 can be substantially similar to bushing 70 discussed above.

In the embodiment shown in FIGS. 13 and 14, the locking rod 40 further includes first and second radial projections 180 and 182. Each radial projection 180 and 182 has a predetermined width. The first radial projection 180 on lock rod 40 is substantially similar to the radial projection 80 discussed above. As best shown in FIG. 14, the second radial projection 182 is axially spaced or separated from the first radial projection 180 by a distance greater than the axial distance separating projections 80 and 82 from each other. Preferably, radial projections 180 and 182 define confronting and generally parallel surfaces 186 and 188, respectively, which are separated by a predetermined axial distance.

In this embodiment, the projection 182 on the lock rod 40 extends away from the outer surface of the lock rod 40 a radial distance greater that the radial distance the inner surface of the generally U-shaped central portion 162 extends away from the axis 50 about which the lock rod 40 rotates when the lock rod 40 is secured to the door. To accommodate such design, guide plate 160 is provided with a slot or opening 163 for allowing at least a portion of the radial projection 182 to project through the guide plate 160. As shown in FIG. 13, the margin of the opening 163 in the guide plate 160 is defined by first and second axially spaced and, preferably, generally parallel edges 165 and 167 which are joined to each by two side edges. When the guide plate 160 is secured to the door, edge 165 of opening 163 is adapted to engage surface 188 on the radial projection 182 such that a first portion 168 of the guide plate 160 is endwise entrapped between the surfaces 186 and 188 defined by the radial projections 180 and 182, respectively.

The projections 180 and 182 on lock rod 40 are preferably designed as annular rings which extend about the lock rod 40. In one form, at least one of the radial projections 180 and 182 is formed integral with the lock rod 40. In a most preferred embodiment, both radial projections 180 and 182 are formed integral with the lock rod 40. It will be appreciated, however, radial projections having design configurations other than that described above can be used without detracting or departing from the spirit and scope of the subject disclosure.

Preferably, the end of the central portion 162 of guide plate 160 disposed adjacent to the camming structure 46 is rolled to provide a generally U-shaped nose portion on the guide plate 160. Preferably, the generally U-shaped nose portion on guide plate 160 extends at least partially about surface 186 on the radial projection 180 on the lock rod 40.

As shown in FIG. 14, when the guide plate 160 is secured to the respective door, a portion 168 of the guide plate 160 extends into and is fixedly accommodated within the axial space defined between the first and second radial projections 180 and 182, respectively, on lock rod 40. As will be appreciated, and after the guide plate 160 is secured to the respective door, with portion 168 of the guide plate 160 accommodated and axially entrapped between the first and second projections 180 and 182 defined by the lock rod 40, the lock rod 40 is inhibited against axial movements while simultaneously allowing for rotation of the lock rod 40 about axis 50 to affect opening and closing of the respective door, as required. Moreover, with portion 168 of guide plate 160 entrapped and held between the first and second radial projections 180 and 182, respectively, on the lock rod 40, the so called "racking" of the doors 24, 26 relative to the door frame 14 (FIG. 1) is inhibited.

Figure 15:
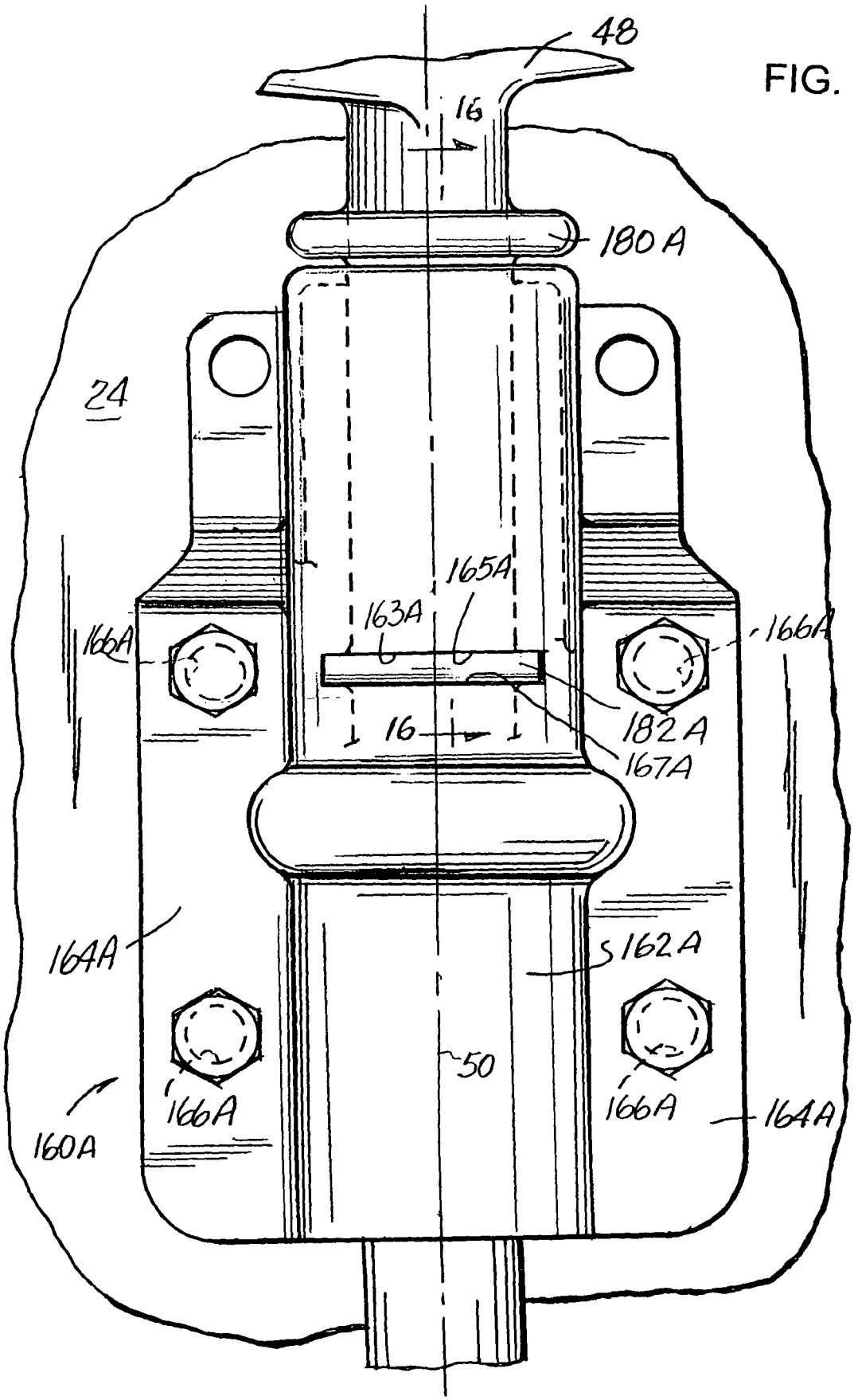
FIG. 15 is an enlarged plan view of an opposite end of the locking rod with another illustrative embodiment of a locking assembly secured to the door of the container.

As shown in FIG. 15, a second guide plate 160A surrounds and entraps another lengthwise portion of the lock rod 40 between the plate 160A and an exterior surface of the respective door to which guide plate is secured. In the embodiment shown in FIG. 15, guide plate 160A has a generally semi-cylindrical or U-shaped central portion 162A and a pair of side flanges 164A extending outwardly from the central portion 162A and adapted to be seated flush against the exterior surface of the door to which the guide plate 160A is secured preferably adjacent to the side edge of the door opposite from the edge hingedly secured to the frame 14 (FIG. 1). In the illustrated embodiment, the side flanges 164A of guide plate 160A are provided with a series of bores or openings 166A so as to allow a series of fasteners, i.e. bolts, to extend therethrough whereby securing the guide plate 160A to the door. The central portion 162A of guide plate 160A has a diameter larger than that portion of the lock rod 40 endwise passing therethrough. In one form, guide plate 160A has a predetermined thickness and is preferably formed from a 10 gauge metal or steel stamping.

Like the other guide plates described above, guide plate 160A furthermore preferably includes a plastic bushing (not shown) for journaling a lengthwise portion of the lock rod 40 passing therethrough. Suffice it to say, the bushing operably associated with guide plate 160A is like the bushing 70 described above or obvious modifications In the embodiment shown in FIG. 15, the lock rod 40 further includes third and fourth radial projections 180A and 182A axially spaced inwardly from and preferably proximate to the camming structure 48 on lock rod 40. Each radial projection has a predetermined width. Preferably, projection 180A extends away from the axis 50 of the lock rod 40 a radial distance equal to or slightly greater than the radial distance an outer surface of the central portion 162A is spaced from the axis 50 of the lock rod 40. Moreover, projection 182A preferably extends away from the axis 50 of the lock rod 40 a radial distance slightly less than the radial distance an inner surface of the central portion 162A is spaced from the axis 50 of the lock rod 40.

Figure 16:
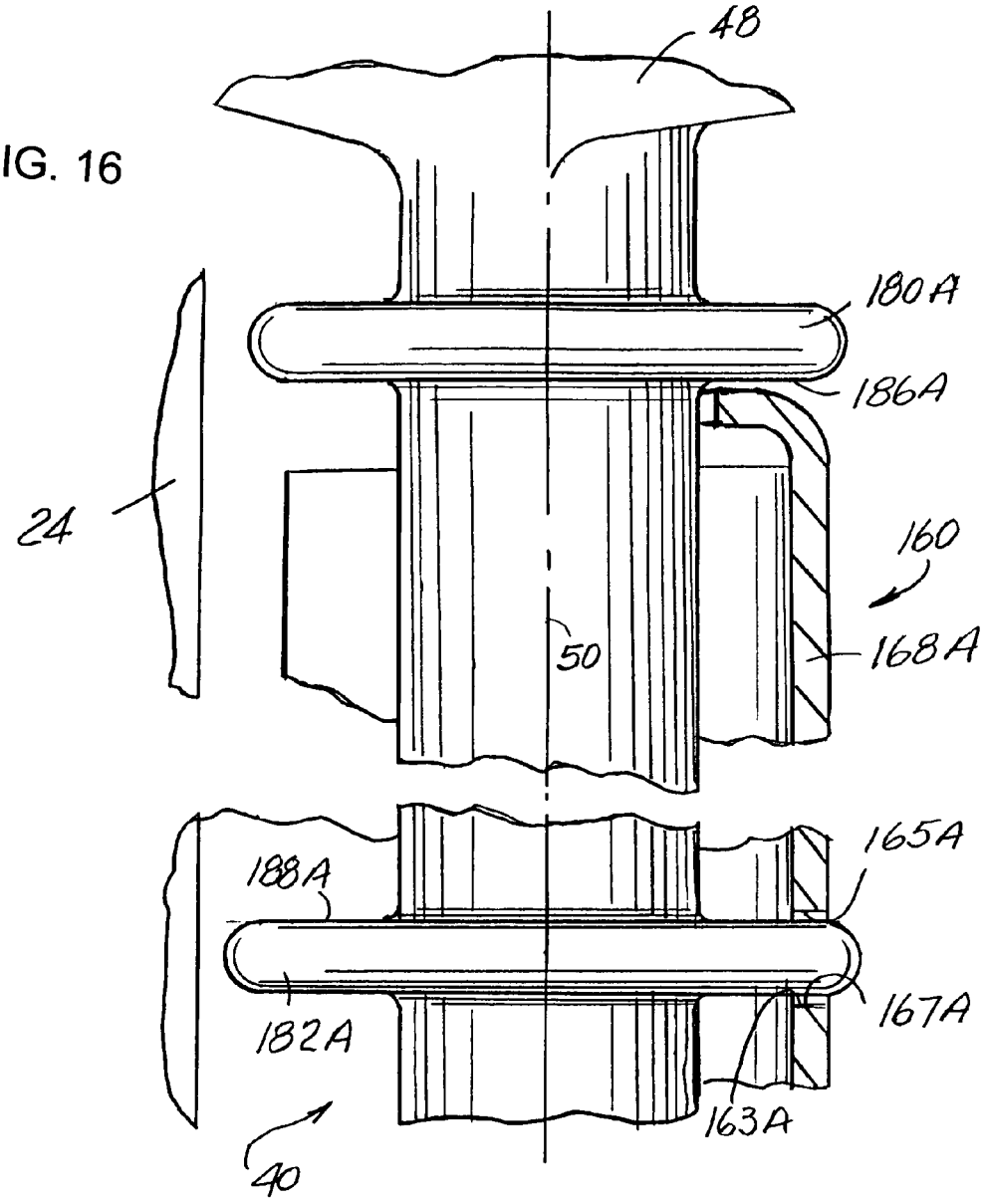
FIG. 16 is a fragmentary sectional view taken along line 16-16 of FIG. 15.

To accommodate such design, guide plate 160A is provided with a slot or opening 163A for allowing at least a portion of the radial projection 182A to project through the guide plate 160A. As shown in FIG. 15, the margin of the opening 163A in the guide plate 160A is defined by first and second axially spaced and, preferably, generally parallel edges 165A and 167A which are joined to each by two side edges. As shown in FIG. 16, when the guide plate 160A is secured to the door, edge 165A of opening 163A is adapted to engage surface 188A on the radial projection 182A such that a portion 168A of the guide plate 160A is endwise entrapped between the surfaces 186A and 188A defined by the radial projections 180 and 182, respectively.

The projections 180A and 182A on lock rod 40 are preferably designed as annular rings which extend about the lock rod 40. In one form, at least one of the radial projections 180A and 182A is formed integral with the lock rod 40. In a most preferred embodiment, both radial projections 180A and 182A are formed integral with the lock rod 40. It will be appreciated, however, radial projections having design configurations other than that described above can be used without detracting or departing from the spirit and scope of the subject disclosure.

Preferably, the end of the central portion 162A of guide plate 160 disposed adjacent to camming structure 48 is rolled to provide a generally U-shaped nose portion on the guide plate 160A. Preferably, the generally U-shaped nose portion on guide plate 160A extends at least partially about surface 186A on the radial projection 180A on the lock rod 40.

As shown in FIG. 16, when the guide plate 160A is secured to the respective door, portion 168A of the guide plate 160A extends into and is fixedly accommodated within the axial space defined between the third and fourth radial projections 180A and 182A, respectively, on lock rod 40. As will be appreciated, and after the guide plate 160A is secured to the respective door, with portion 168A of the guide plate 160A accommodated and axially entrapped between the third and fourth projections 180A and 182A defined by the lock rod 40, the lock rod 40 is inhibited against axial movements while simultaneously allowing for rotation of the lock rod 40 about axis 50 to affect opening and closing of the respective door, as required. Moreover, with portion 168A of guide plate 160A entrapped and held between the third and fourth radial projections 180A and 182A, respectively, on the lock rod 40, the so called "racking" of the doors 24, 26 relative to the door frame 14 (FIG. 1) is inhibited.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A locking assembly operable in combination with keepers for a swinging door of a container, said locking assembly comprising:

an axially elongated lock rod defining a rotational axis of said locking assembly and having cam structure at opposed ends thereof, with said lock rod being provided toward a first end thereof with first and second axially spaced radial projections defining a channel therebetween, and with said first and second projections being axially fixed relative to said lock rod; and first and second axially spaced guide plates, with each guide plate including an axially elongated body portion having a generally U-shaped cross-sectional configuration of a generally constant predetermined thickness for rotatably accommodating a lengthwise portion of said lock rod between the guide plate and said door, and with each guide plate further including structure for allowing each plate to be fastened to the door, with said first guide plate defining a rolled nose end portion formed with and having generally the same constant predetermined thickness as the body portion of said first guide plate, with said rolled nose end portion extending from said body portion and generally normal to the rotational axis of said locking assembly and extending into the channel between and about a majority of first and second surfaces on said first and second axially spaced radial projections, respectively, on said lock rod when said first guide plate is fastened to the door with the lock rod entrapped between said first guide plate and said door, with the rolled nose end portion on said first guide plate and said first and second axially spaced radial projections on said lock rod combining to inhibit axial shifting movements of the lock rod relative to the door.

2. The locking assembly according to claim 1 wherein, the axial spacing between the first and second surfaces on the first and second radial projections, respectively, on said lock rod is generally equal to or slightly greater than the predetermined thickness of the rolled nose end portion of the body portion of said first guide plate.

3. The locking assembly according to claim 1 wherein, at least one of said first and second radial projections on said lock rod is formed integral with said lock rod.

4. The locking assembly according to claim 1 wherein, both of said first and second radial projections on said lock rod are formed integral with said lock rod.

5. The locking assembly according to claim 1 wherein, said lock rod is provided toward a second end thereof with third and fourth axially spaced radial projections defining a second channel therebetween, with said third and fourth projections being axially fixed relative to said lock rod.

6. The locking assembly according to claim 5 wherein, said second guide plate defines a rolled nose end portion formed with and having generally the same constant predetermined thickness as the body portion of said second guide plate, with the rolled nose end portion on said second guide plate extending from the body portion of said second guide plate and generally normal to the rotational axis of said locking assembly and extending into the second channel between and about a majority of third and fourth surfaces on said third and fourth axially spaced radial projections, respectively, on said lock rod when said second guide plate is fastened to the door with the lock rod trapped between said second guide plate and said door, with the rolled nose end portion on said second guide plate and said third and fourth axially spaced radial projections on said lock rod combining to inhibit axial shifting movements of the lock rod relative to the door.

7. The locking assembly according to claim 6 wherein, the axial spacing between the third and fourth surfaces on the third and fourth radial projections, respectively, on said lock rod is generally equal to or slightly greater than the predetermined thickness of the rolled nose end portion on the body portion of said second guide plate.

8. The locking assembly according to claim 6 wherein, at least one of said third and fourth radial projections on said lock rod is formed integral with said lock rod.

9. The locking assembly according to claim 6 wherein, both of said third and fourth radial projections on said lock rod are formed integral with said lock rod.

10. The locking assembly according to claim 1 wherein, a handle is connected to and extends radially outward from said lock rod for facilitating rotation of said lock rod.

11. A locking assembly for a container having a door pivotally supported for swinging movements within a complimentary door frame on said container, with said door frame having a top member and a bottom member rigidly joined to each other by generally parallel side members, with said locking assembly comprising:

a lock rod having first and second ends;

cam structure provided toward each end of said lock rod for movably engaging and operably cooperating with a first keeper secured to the bottom member of the door frame and a second keeper secured to the top member of the door frame whereby either releasably and selectively holding said door in a closed position or for allowing said cam structure to release and separate from said keepers so as to allow said door to be swung to an open position;

a first and a second guide plate adapted to be secured to said door on said container, with a body portion of each guide plate being configured to movably engage and entrap a lengthwise portion of said lock rod between each guide plate and said door in a manner permitting said lock rod to rotate about a fixed axis, with the body portion of each guide plate having an axially elongated generally U-shaped cross-sectional configuration and a generally constant predetermined thickness; and wherein said first guide plate defines a rolled nose end portion formed with and having generally the same predetermined thickness as the body portion, with said rolled nose end portion extending from said body portion and generally normal to the fixed axis about which said lock rod rotates and into a channel defined between and about a majority of first and second surfaces on first and second axially spaced radial projections, respectively, on said lock rod when said first guide plate is fastened to the door, with the rolled nose end portion on said first guide plate and said first and second axially spaced radial projections on said lock rod combining to inhibit axial shifting movements of the lock rod relative to said door.

12. The locking assembly according to claim 11 wherein, the axial spacing between the first and second surfaces on the first and second radial projections, respectively, on said lock rod is generally equal to or slightly greater than the predetermined thickness of the rolled nose end portion on the body portion of said guide plate.

13. The locking assembly according to claim 11 wherein, at least one of said first and second radial projections on said lock rod is formed integral with said lock rod.

14. The locking assembly according to claim 11 wherein, both of said first and second radial projections on said lock rod are formed integral with said lock rod.

15. The locking assembly according to claim 11 wherein, said lock rod is provided toward the second end thereof with third and fourth axially spaced radial projections arranged for rotation with said lock rod and defining a second channel between said third and fourth axially spaced radial projections.

16. The locking assembly according to claim 15 wherein, said second guide plate defines a rolled nose end portion formed with and having generally the same constant predetermined thickness as the body portion of said second guide plate, with the rolled nose end portion on said second guide plate extending from the body portion of said second guide plate and generally normal to the fixed axis of rotation of said lock rod and extending into the second channel between and about a majority of third and fourth surfaces on said third and fourth axially spaced radial projections, respectively, on said lock rod when said second guide plate is fastened to the door, with the rolled nose end portion on said second guide plate and said third and fourth axially spaced radial projections on said lock rod combining to inhibit axial shifting movements of the lock rod relative to said door.

17. The locking assembly according to claim 16 wherein, the axial spacing between the third and fourth surfaces on the third and fourth radial projections, respectively, on said lock rod is generally equal to or slightly greater than the predetermined thickness of the rolled nose end portion on the body portion of said second guide plate.

18. The locking assembly according to claim 16 wherein, at least one of said third and fourth radial projections on said lock rod is formed integral with said lock rod.

19. The locking assembly according to claim 16 wherein, both of said third and fourth radial projections on said lock rod are formed integral with said lock rod.

20. The locking assembly according to claim 11 wherein, a handle is connected to and extends radially outward from said lock rod for facilitating rotation of said lock rod.

21. A locking assembly for a vehicle trailer having an open end, two doors pivotally supported for swinging movements within a complimentary door frame on said trailer, with said door frame having a top member and a bottom member rigidly joined to each other by generally parallel side members, with said locking assembly comprising:

a lock rod having first and second ends, with said lock rod being rotatably mounted in an upright position on one of the doors of said vehicle trailer;

cam structure provided toward each end of said lock rod, with each cam structure including a locking tongue for movably engaging and cooperating with a first keeper secured to the bottom member of the door frame and a second keeper secured to the top member of the door frame whereby either releasably and selectively holding said one of the doors in a closed position or for allowing said locking tongue to be released and separated from said keepers so as to allow said one of the doors to be swung to an open position;

a first and a second guide plate for securely mounting said lock rod to said one of the doors, with each guide plate having an axially elongated body portion with a generally U-shaped cross-section which fits about to movably engage and entrap a lengthwise portion of said lock rod between each guide plate and said one of the doors in a manner permitting said lock rod to rotate about a fixed axis, with the body portion of each guide plate having a generally constant predetermined thickness; and wherein said first guide plate defines a rolled nose end portion formed integral with and having generally the same predetermined thickness as the body portion of said first guide plate, with said rolled nose end portion of said first guide plate extending generally normal to the fixed axis about which said lock rod rotates and having a free end extending into an axial space defined between and about a majority of first and second surfaces on first and second axially spaced radial projections, respectively, on said lock rod when said first guide plate is fastened to said one of the doors, with said rolled nose end portion on said first guide plate and said first and second axially spaced radial projections on said lock rod combining to inhibit racking movements of said one of the doors as said vehicle moves between locations.

22. The locking assembly according to claim 21 wherein, at least one of said first and second radial projections on said lock rod is formed integral with said lock rod.

23. The locking assembly according to claim 21 wherein, both of said first and second radial projections on said lock rod are formed integral with said lock rod.

24. The locking assembly according to claim 21 wherein, said lock rod is provided toward the second end thereof with third and fourth axially spaced radial projections arranged for rotation with said lock rod and defining a second channel therebetween.

25. The locking assembly according to claim 24 wherein, a rolled nose end portion is provided on the second guide plate, with the rolled nose end portion on said second guide plate being formed with and having generally the same constant predetermined thickness as the body portion of the second guide plate, and with the rolled nose end portion on said second guide plate extending from the body portion of the second guide plate and generally normal to the fixed axis of rotation of said lock rod and extends into the second channel defined between said third and fourth axially spaced radial projections on said lock rod when the second guide plate is fastened to said one of the doors, with the rolled nose end portion on said second guide plate and said third and fourth axially spaced radial projections on said lock rod combining to further inhibit racking movements of said one of the doors as said vehicle moves between locations.

26. The locking assembly according to claim 24 wherein, at least one of said third and fourth radial projections on said lock rod is formed integral with said lock rod.

27. The locking assembly according to claim 24 wherein, both of said third and fourth radial projections on said lock rod are formed integral with said lock rod.

28. The locking assembly according to claim 21 wherein, a handle is connected to and extends radially outward from said lock rod for facilitating rotation of said lock rod.

29. A locking assembly operable in combination with keepers for a swinging door of a container, said locking assembly comprising:

an axially elongated lock rod having cam structure at opposed ends thereof, with said lock rod being provided toward a first end thereof with a radial projection having a radial edge along with first and second axially spaced and generally parallel surfaces, with said radial projection being axially fixed relative to said lock rod; and first and second axially spaced guide plates, with each guide plate including an axially elongated body portion with a generally U-shaped cross-sectional configuration extending between opposed ends of said guide plate for rotatably accommodating a lengthwise portion of said lock rod between the plate and said door, and with each guide plate further including structure for allowing each guide plate to be fastened to the door, and wherein, between the opposed ends thereof, an area of the body portion of said first guide plate defines an opening having axially spaced and generally parallel first and second surfaces, with the axial spacing between said first and second surfaces on said first guide plate being generally equal to or slightly greater than the axial spacing between the first and second generally parallel surfaces on the radial projection on said lock rod and such that, after said lock rod is fastened to the door with the lock rod entrapped between said first guide plate and said door, the radial edge of the radial projection on said lock rod projects through the opening in and beyond an exterior of the area of the body portion of the first guide plate wherein said opening is defined such that the first and second surfaces of said projection are entrapped between said first and second surfaces on said first guide plate whereby inhibiting shifting movements of said lock rod in either axial direction relative to said door.

30. The locking assembly according to claim 29 wherein, said lock rod is provided toward a second end thereof with a second radial projection having a radial edge along with third and fourth axially spaced and generally parallel surfaces, with said second radial projection being axially fixed relative to said lock rod.

31. The locking assembly according to claim 30 wherein, an area of the body portion of said second guide plate defines an opening having axially spaced and generally parallel third and fourth surfaces, with the axial spacing between said third and fourth surfaces on said second guide plate being generally equal to or slightly greater than the axial spacing between the third and fourth generally parallel surfaces on the second radial projection on said lock rod and such that, after said lock rod is fastened to the door with the lock rod entrapped between said second guide plate and said door, the second radial projection on said lock rod projects through the opening in and beyond an exterior of the area of the body portion of the second guide plate wherein said opening is defined such that the third and fourth surfaces of the second radial projection are entrapped between said third and fourth surfaces on said second guide plate whereby furthermore inhibiting shifting movements of said lock rod in either axial direction relative to said door.

32. The locking assembly according to claim 31 wherein, at least one of said radial projections on said lock rod is formed integral with said lock rod.

33. The locking assembly according to claim 31 wherein, both of said radial projections on said lock rod are formed integral with said lock rod.

* * * * *